US005502427A

United States Patent [19]

Scherer et al.

[11] Patent Number: 5,502,427

[45] Date of Patent: Mar. 26, 1996

[54] FUSE ASSEMBLY WITH LOW EXHAUST AND REPLACEABLE CARTRIDGE

[75] Inventors: Henry W. Scherer, Gurnee; Bruce A. Biller, Chicago; Hiram S. Jackson, Morton Grove; Roy T. Swanson, La Grange Park; David W. Zabel, Evanston, all of Ill.

[73] Assignee: S&C Electric Company, Chicago, Ill.

[21] Appl. No.: 227,202

[22] Filed: Apr. 7, 1994

[51] Int. Cl.[6] ..... H01H 71/10; H01H 85/04

[52] U.S. Cl. ..... 337/176; 337/171; 337/159

[58] Field of Search ..... 337/168, 169, 337/170, 171, 172, 173, 174, 159, 176

[56] References Cited

U.S. PATENT DOCUMENTS

| | | | |
|---|---|---|---|
| 816,443 | 3/1906 | Eveleth | 337/203 |
| 1,993,866 | 3/1935 | Steinmayer | 337/203 |
| 2,058,594 | 10/1936 | Kelsay | 337/203 |
| 2,091,453 | 8/1937 | Ramsey | 200/117 |
| 2,108,993 | 2/1938 | Ramsey | 200/114 |
| 2,118,646 | 5/1938 | Hermann | 200/116 |
| 2,172,143 | 9/1939 | Lemmon | 200/116 |
| 2,183,728 | 12/1939 | Tripplett | 200/117 |
| 2,183,751 | 12/1939 | McMahon et al. | 200/117 |
| 2,239,829 | 4/1941 | Pittman et al. | 200/116 |
| 2,265,521 | 12/1941 | Elliott | 200/114 |
| 2,269,610 | 1/1942 | Thompson | 200/116 |
| 2,323,213 | 6/1943 | Garrison, Jr. | 200/114 |
| 2,365,113 | 12/1944 | Schultz | 200/114 |
| 2,390,670 | 12/1945 | Steinmayer | 200/114 |
| 2,435,844 | 2/1948 | Rawlins | 200/114 |
| 2,441,692 | 5/1948 | Earle | 200/114 |
| 2,549,635 | 4/1951 | Pittman | 200/114 |
| 2,585,003 | 2/1952 | Gesellschap | 200/114 |
| 2,614,192 | 10/1952 | Appleman | 200/123 |
| 2,716,681 | 8/1955 | Smith | 200/120 |
| 2,901,573 | 8/1959 | Gesellschap | 200/114 |
| 2,917,605 | 12/1959 | Fahnoe | 200/114 |
| 3,611,240 | 10/1971 | Mikulecky | 337/169 |
| 3,827,010 | 7/1974 | Cameron et al. | 337/168 |
| 3,863,187 | 1/1975 | Mahieu et al. | 337/162 |
| 3,893,056 | 7/1975 | Harner | 337/283 |
| 4,011,537 | 3/1977 | Jackson, Jr. et al. | 337/171 |
| 4,114,128 | 9/1978 | Cameron | 337/162 |
| 4,121,186 | 10/1978 | Santilli | 337/161 |
| 4,161,712 | 7/1979 | Thiel | 337/159 |
| 4,184,138 | 1/1980 | Beard et al. | 337/168 |
| 4,313,100 | 1/1982 | Schmunk | 337/168 |
| 4,906,961 | 3/1990 | Scherer | 337/186 |
| 5,274,349 | 12/1993 | Hassler et al. | 337/171 |

*Primary Examiner*—Leo P. Picard
*Assistant Examiner*—Stephen T. Ryan
*Attorney, Agent, or Firm*—J. V. Lapacek

[57] ABSTRACT

A low-exhaust composite drop-out assembly is provided that is utilizable in a standard cutout mounting in electrical power distribution systems. The composite drop-out assembly includes current-limiting and low-current clearing sections and is easily removable from the mounting for servicing. The sections are efficiently arranged in a side by side configuration. The low-current clearing section includes a fuse-tube assembly having a replaceable fuse cartridge. Accordingly, the low-current clearing section is simply and economically renewable for reuse whether or not the current-limiting section has operated. Further, the current-limiting section need not be replaced if only the low-current clearing section operated in response to overcurrent in a low range. Additionally, the sections are separable so that the low-current clearing section can be reused after simple refusing even when the current-limiting section has operated.

33 Claims, 11 Drawing Sheets

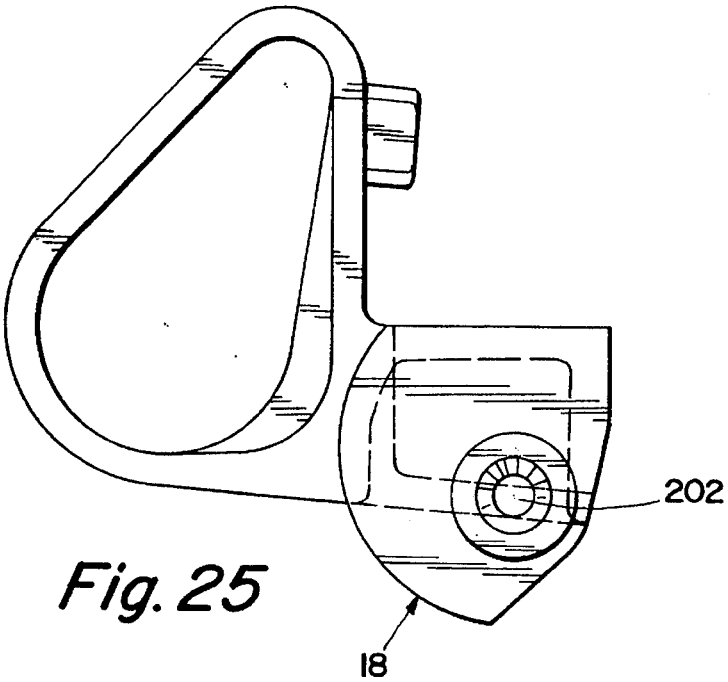
Fig. 25
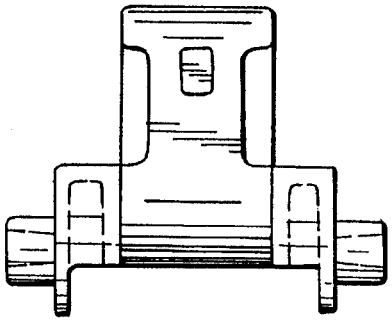
Fig. 27
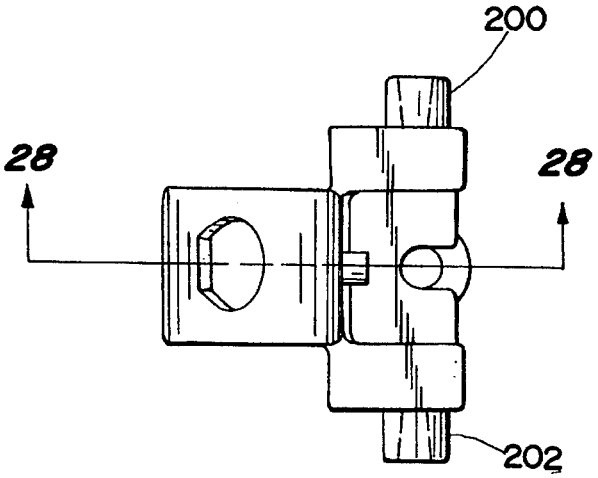
Fig. 26
Fig. 28
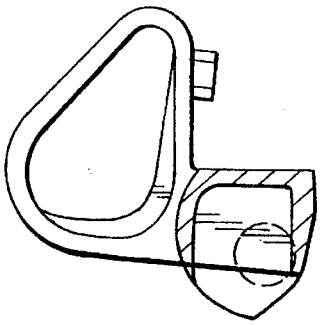

FUSE ASSEMBLY WITH LOW EXHAUST AND REPLACEABLE CARTRIDGE

CROSS-REFERENCE TO RELATED APPLICATION

This application is directed in part to a current-limiting assembly of the basic type disclosed and claimed in commonly-assigned, copending application Ser. No. 08/225,161 filed in the name of Hiram S. Jackson on (contemporaneously herewith), and that application is incorporated by reference herein for all purposes.

BACKGROUND OF THE INVENTION

1. Field of the Invention

The present invention relates generally to current-interrupting devices for electrical power distribution systems and more particularly to a low-exhaust composite drop-out fuse assembly that is usable with a standard cutout mounting, provides current-limiting characteristics, and includes a low-current clearing section that is simply and economically renewable for reuse.

2. Description of the Related Art

Various assemblies and devices have been proposed to provide current interrupters in electrical power distribution circuits that have reduced exhaust characteristics as compared to distribution cutouts with replaceable fuse links. The class of expulsion fuses known as cutouts have undesirable exhaust characteristics that are well known in the industry and discussed in the literature, e.g. see ANSI/IEEE standard C37.48 and the U.S. Patents discussed herein. One approach to reduce the exhaust of expulsion devices as set forth in U.S. Pat. No. 3,863,187 provides the series connection of a current limiting fuse with a conventional cutout. The current limiting fuse is connected to one of the terminals of the cutout mounting and is not part of the drop-out fuse tube assembly. While this approach does reduce the exhaust characteristics of the cutout and also provides current limiting of the faults in the circuit, it also has undesirable characteristics regarding installation and maintenance. Specifically, the current limiting fuse is difficult to replace from a distance which requires the lineman to either deenergize the lines or come in close proximity to energized lines. Obviously, since safety of operating personnel is an important essential of any product use, neither alternative is readily acceptable. Since there is no provision to easily determine whether or not the current limiting fuse has operated, this requires the difficult servicing procedure every time that the cutout operates and drops out.

Other approaches are directed to the provision of a composite or combined assembly some of which are of the drop-out type. These composite assemblies provide a single assembly or device that is the combination of a current limiting fuse with another lower-current fuse or cutout. For example, approaches of this type are shown in U.S. Pat. Nos. 3,893,056, 5,274,349, 4,011,537, 3,827,010, 4,184,138, 4,114,128, 4,121,186, 4,161,712 and 2,917,605.

The arrangement of U.S. Pat. No. 3,893,056, which is not directed to a drop-out assembly or a disconnect mounting, utilizes the interior of the current limiting section to accommodate operational portions of the expulsion fuse section such as the arcing rod or a muffler portion. However, the fuse sections are not separable and the expulsion fuse is a one-shot device that does not have provisions for refusing.

A current-limiting drop-out fuse is shown in U.S. Pat. No. 5,274,349. This arrangement is not vented (no exhaust provisions) and also includes a low-current clearing section. Unfortunately, the entire one-piece fuse body must be replaced after all types of operation, i.e. even after clearing low-range overcurrents.

The other aforementioned composite or combined assemblies (e.g. as shown in the aforementioned U.S. Pat. Nos. 4,011,537, 3,827,010, 4,184,138, 4,114,128, 4,121,186, 4,161,712 and 2,917,605) also provide some desirable features but suffer from one or more drawbacks. For example, they all utilize expulsion fuse sections of the cutout type that have the undesirable exhaust characteristics as a result of open-ended fuse tubes through which a fuse-links cable exits. Further, regarding mechanical configuration, these arrangements all have the problem of fitting the cutout fuse tube and the current-limiting fuse within the straight line distance between the mounting terminals. While the composite fuse assembly of the aforementioned U.S. Pat. No. 4,184,138 provides a cutout fuse tube at an angle to the current-limiting fuse such that the combined lengths of the two sections may be somewhat greater than the straight line distance, this configuration still results in a very short length that is available for the cutout fuse tube. The remainder of the aforementioned arrangements utilize in-line configurations of the cutout fuse tube and the current-limiting fuse such that the available length must be divided between the two devices. Additionally, some of the aforementioned arrangements are not usable with existing standard cutout mountings which would require the purchase and installation of new mountings throughout a distribution system.

While the prior art arrangements may be useful to provide combinations of current interrupting devices with other devices, none of these previous approaches provides a desirable commercial replacement for a distribution cutout, namely a drop-out assembly with low exhaust characteristics that is usable in a standard cutout mounting and that allows the current-limiting section to be reused when only the low-current section has operated.

SUMMARY OF THE INVENTION

Accordingly, it is a principal object of the present invention to provide a composite drop-out fuse assembly with current-limiting and low-exhaust characteristics that is usable with a standard cutout mounting and includes a low-current section that is capable of reuse after a simple refusing operation.

It is another object of the present invention to provide a drop-out fuse assembly for a standard cutout mounting that includes a current-limiting section and a refusable low-current clearing section having low exhaust characteristics.

It is a further object of the present invention to provide a drop-out current-interrupting assembly for a standard cutout mounting with a side-by-side configuration of a current limiting section and a refusable low-exhaust current-clearing section.

It is yet another object of the present invention to provide a separable fuse tube assembly for a composite drop-out assembly for use in a standard cutout mounting wherein the fuse tube assembly includes a pivotable release feature that is adjacent the upper terminal of the cutout mounting and that is responsive to operation of a fuse cartridge carded by the fuse tube assembly to release the composite drop-out assembly from the cutout mounting via the pivoting of the composite drop-out assembly with respect to the lower terminal of the cutout mounting.

It is another object of the present invention to provide a separable current-limiting section for a composite drop-out assembly for use with a cutout mounting, the current-limiting section including exhaust control and venting provisions for a low-current clearing section of the composite drop-out assembly.

It is a further object of the present invention to provide a composite drop-out fuse for use with a cutout mounting including a first section being generally tubular and housing a first fusible element and a second section being a generally flat polyhedron and housing a second fusible element, the two sections being assembled in a predetermined side by side configuration and including arrangements to connect the first and second fusible elements in an electrical series circuit and to connect the series circuit between the upper and lower terminals of the cutout mounting.

These and other objects of the present invention are efficiently achieved by the provision of a low-exhaust composite drop-out assembly that is utilizable in a standard cutout mounting in electrical power distribution systems. The composite drop-out assembly includes current-limiting and low-current clearing sections and is easily removable from the mounting for servicing. The sections are efficiently arranged in a side by side configuration. The low-current clearing section includes a fuse-tube assembly having a replaceable fuse cartridge. Accordingly, the low-current clearing section is simply and economically renewable for reuse whether or not the current-limiting section has operated. Further, the current-limiting section need not be replaced if only the low-current clearing section operated in response to overcurrent in a low range. Additionally, the sections are separable so that the low-current clearing section can be reused after simple refusing even when the current-limiting section has operated.

BRIEF DESCRIPTION OF THE DRAWING

The invention, both as to its organization and method of operation, together with further objects and advantages thereof, will best be understood by reference to the specification taken in conjunction with the accompanying drawing in which:

FIG. 13 is a sectional view taken along the line 12—12 of FIG. 10;

FIGS. 25–27 are respective front, top-plan, and left-side elevational views of a trunnion of the composite drop-out fuse of FIGS. 1–3 fits into the lower hinge of a standard cutout mounting;

FIG. 28 is a sectional view taken along the line 28—28 of FIG. 26;

DETAILED DESCRIPTION

Figure 1:
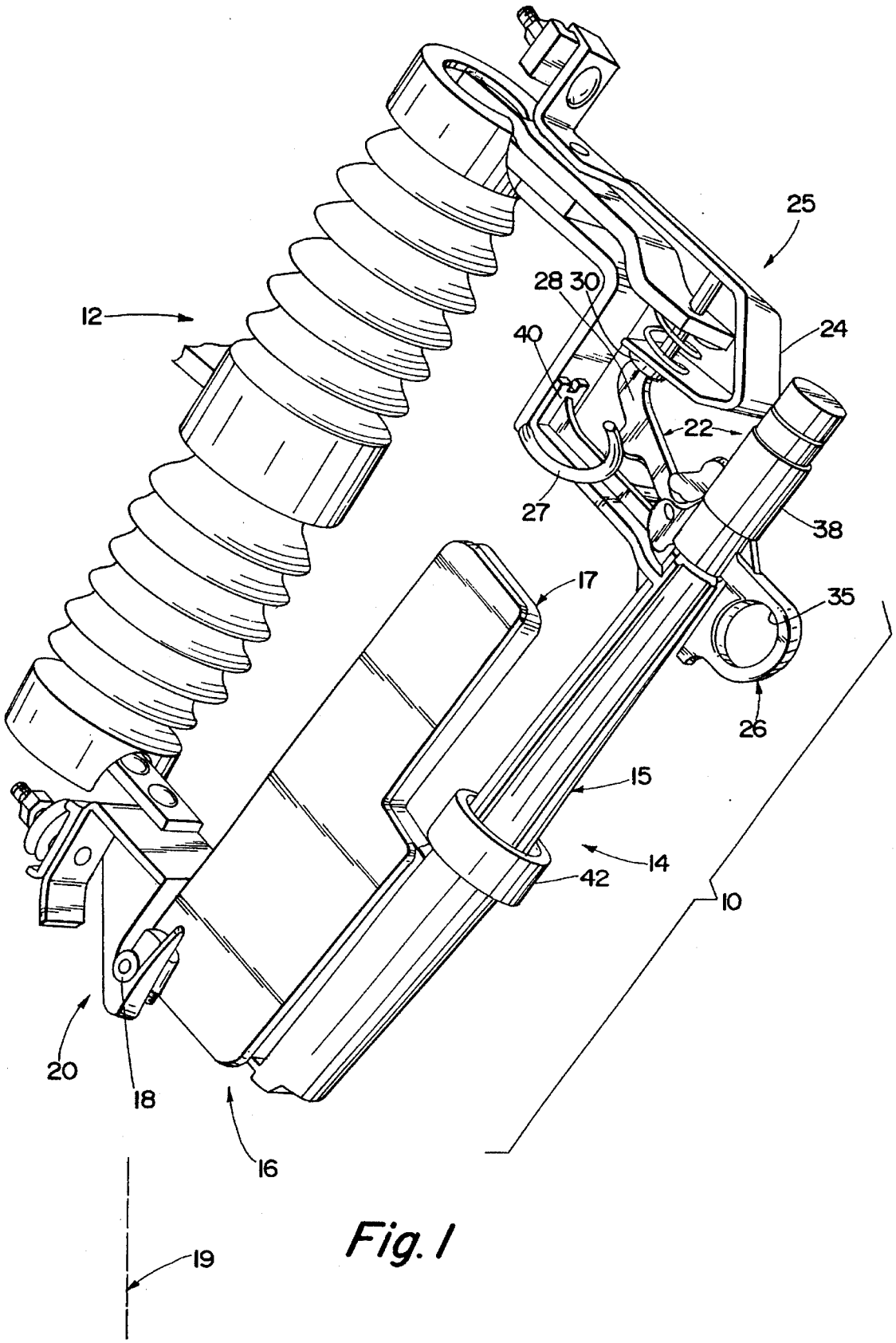
FIG. 1 is a perspective view of a composite drop-out fuse in a standard cutout mounting in accordance with the principles and features of the present invention.

Referring now to FIG. 1, a composite drop-out fuse 10 of the present invention as illustrated in a standard cutout mounting 12 provides full range protection according to a predetermined time-current characteristic curve so as to limit fault currents and interrupt the circuit while exhibiting low exhaust characteristics. The cutout mounting 12 is of the type as illustrated in U.S. Pat. No. 4,414,527 and is adapted to mount a fuse tube with installed fuse link as is commonly used throughout electrical power distribution systems. The composite drop-out fuse 10 includes a low-current section generally referred to at 14 and a current-limiting section generally referred to at 16 which are connected in electrical series-circuit relationship and physically arranged in a generally side by side configuration. In response to overcurrents (faults) in a low range that do not exceed a predetermined level, only the low-current section 14 operates to interrupt the current whereupon after location and correction of the condition causing the overcurrent, the low-current section 14 can be refused as will be explained in more detail hereinafter. For overcurrents (faults) that exceed the predetermined level, i.e. high range overcurrents, the current-limiting section 16 limits the overcurrent and the low-current section 14 operates to interrupt the overcurrent. For these high-range overcurrents, the current-limiting section 16 requires replacement and the low-current section 14 requires refusing.

In accordance with important aspects of the present invention and with additional reference now to FIGS. 2 and 3, the current-limiting section 16 is provided by a limiter assembly 17 and the low-current section 14 is provided by a fuse tube assembly 15 along with portions of the limiter assembly 17 which provide exhaust control and venting functions which will be explained in more detail hereinafter. The limiter assembly 17 and the fuse tube assembly 15 include cooperating features and interfitting arrangements for the assembly into the composite drop-out fuse 10 having a predetermined configuration as shown in FIGS. 1 and 3 and for providing the series electrical interconnection of the sections 14 and 16. The limiter assembly 17 includes a trunnion arrangement 18 that interfits with a lower mounting contact arrangement 20 of the mounting 12 so as to support the composite drop-out fuse 10 and provide electrical connection. The fuse tube assembly 15 includes an upper contact assembly 22 that cooperates with a spring contact 24 of an upper mounting contact arrangement 25 of the mounting 12 so as to retain the composite drop-out fuse 10 within the mounting 12 and provide electrical connection.

Figure 4:
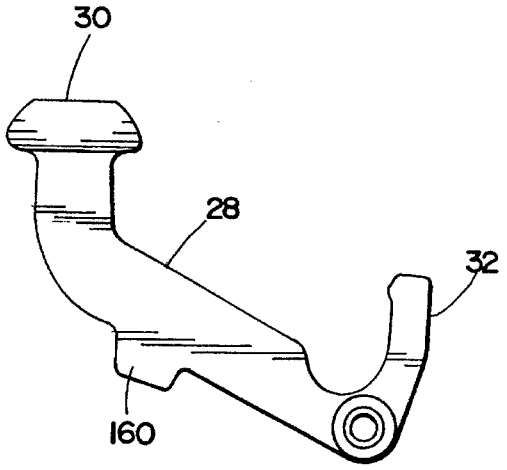
FIGS. 4 and 5 are respective front elevational and top plan views of a movable contact arm of the composite drop-out fuse of FIGS. 1–3.
Figure 5:
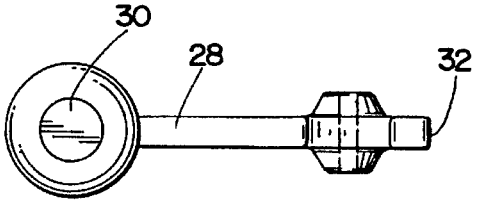
Figure 6:
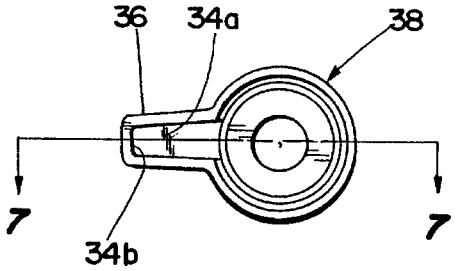
FIG. 6 is a bottom plan view of an upper ferrule of the composite drop-out fuse of FIGS. 1–3.
Figure 7:
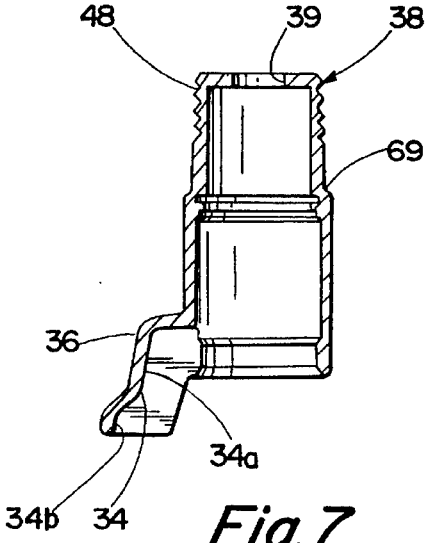
FIG. 7 is a sectional view taken along the line 7—7 of FIG. 6.

The upper contact assembly 22 also includes a pull ring assembly 26 defining a pull ring 35 which may be engaged by a hookstick (not shown) or a portable loadbreak tool (not shown) to move the upper contact assembly 22 away from the upper contact of the mounting 12 while the trunnion and lower contact arrangement 18 rotates in the lower contact or hinge 20 of the mounting 12, the portable loadbreak tool being required to open the composite drop-out fuse 10 unless the circuit is deenergized. The cutout mounting 12 also includes attachment hooks 27 for use with a portable loadbreak tool. The composite drop-out fuse 10 also includes a release feature which provides for the drop out of the composite drop-out fuse 10 upon operation of the low-current section 14 such that the composite drop-out fuse 10 moves from the position as shown in FIG. 1 to a drop out position similar to the position assumed by cutouts upon operation and the same as the composite drop-out fuse when opened and rotated by a hookstick or the like, with the fuse tube assembly 15 moving to the position as illustrated by the axis generally referred to at 19 in FIG. 1. The release feature is provided by a movable contact arm 28, the details of which are best illustrated in FIGS. 4 and 5. The movable contact arm 28 is carried by and pivotally mounted with respect to the fuse tube assembly 15 at a pivot point 29. A pivot pin 31 is carried through a collar 33 of the pull ring assembly 26 to pivotally mount the movable contact arm 28 at the pivot point 29. At one end remote from the pivot point 29, the movable contact arm 28 is provided with a contact 30 which is generally convex and suitably contoured and shaped to interfit with a generally concave indentation 24a as found in the standard cutout mounting 12, such that the contact 30 fits into and is held by the indentation 24a and suitable electrical contact pressure is maintained between the spring contact 24 and the contact 30. The contact arm 28 also includes a contact finger 32 at a second end of the contact arm 28 on the opposite side of the pivot point 29 from the contact 30. The contact finger 32 is captured within a guide channel or surface 34 that is formed by an extending portion 36 of an upper ferrule 38 of the upper contact assembly 22, the details of the upper ferrule being best illustrated in FIGS. 6 and 7. The contact arm 28 is fabricated to provide a suitably conductive path from the spring contact 24 to the upper ferrule 38. The upper ferrule 38 is movably mounted with respect to the fuse tube assembly 15 as will be explained in more detail hereinafter.

Upon operation of the low-current section 14 in response to overcurrents, the upper ferrule 38 moves upward such that the portion 36 assumes the position shown in phantom in FIG. 3 as 36'. As the upper ferrule 38 moves upwardly, the contact finger 32 moves along the surface from 34*a* to 34*b* whereupon the contact arm 28 pivots to the position shown in FIG. 2. The pivoting of the contact arm 28 (counterclockwise in FIG. 1 ) shortens the overall length of the composite drop-out fuse 10 from the trunnion 18 to the contact 30 resulting in the release of the composite drop-out fuse 10 to pivot or rotate from the closed position in FIG. 1 to the drop out position. To aid in closing the composite drop-out fuse 10 and supporting the composite drop-out fuse 10 within the mounting 12, the fuse tube assembly 15 includes a guide/support arm 40 extending therefrom which is arranged to fit between the attachment hooks 27 and stop against a central portion of the attachment hooks 27. The collar 33 of the pull ring assembly 26 is pressed on and affixed to the fuse tube assembly 15 by attachment to the guide/support arm 40 via a pin or the like 41. Accordingly, the orientation of the upper ferrule 38 is suitably controlled via the finger 32 of the contact arm 28 within the guide surface or channel 34 of the upper ferrule 38, which in turn is fixed in orientation with respect to rotation about the fuse tube assembly 15 by the collar 33. It should also be noted that the guide surface or channel 34 of the upper ferrule 38 is dimensioned and contoured along with the contact finger 32 to ensure after pivoting to a release position, the contact arm 28 will be free to pivot in a return direction (clockwise in FIG. 1) as the upper ferrule returns to its normal lowered position after moving upward during fuse operation and release from the cutout mounting 12. In this way, the fuse tube assembly 15, after refusing, is ready for use with appropriate functioning of the contact arm 28.

With the composite drop-out fuse 10 removed from the mounting 12, the fuse tube assembly 15 is refused and if required, the limiter assembly 17 is replaced. To allow refusing and as shown in FIG. 2, the fuse tube assembly 15 is separable from the limiter assembly 17 via the disassembly of a threaded collar 42 that is carried by the fuse tube assembly 15 from a mating threaded portion 44 of the limiter assembly 17. A threaded cap 46 closes the top of the upper ferrule 38 of the fuse tube assembly 15 via attachment with a threaded portion 48 of the upper ferrule 38. The fuse tube assembly 15 includes a removable spring/cable assembly 50 and a fuse cartridge 52 which is carried by the spring/cable assembly 50. With the spring/cable assembly 50 and the fuse cartridge 52 installed for operation, the spring/cable assembly 50 is stretched so as to apply tension to the fuse cartridge 52 which is affixed at its lower end to the bottom of the fuse tube assembly 15. When the low-current section 14 operates, portions of the fuse cartridge 52 melt, vaporize, and become disintegral. An upper terminal 54 of the fuse cartridge 52 moves toward the top of the fuse tube assembly 15 responsive to the tension in the spring/cable assembly 50, separating the upper terminal 54 from a lower terminal 56 of the fuse cartridge 52. In accordance with well known principles, the lengthening of the gap in combination with the release of arc-extinguishing gases inside the fuse tube assembly 15 interrupts current flow in the fuse tube assembly 15 at the time of current zero in the alternating current wave form. When refusing the fuse tube assembly 15, the spring/cable assembly 50 is removed from the fuse tube assembly 15. Next, the remnants of the fuse cartidge 52 are removed, namely the upper terminal 54 is unthreaded from the spring/cable assembly 50, any particles are removed from the open section of the limiter assembly 17 and the interior of the fuse tube assembly 15. A new fuse cartridge 52 is attached to the spring/cable assembly 50, and the combination is installed in the fuse tube assembly 15 by dropping it into the fuse tube assembly 15, extending the lower terminal 56 through the fuse tube assembly 15 and seating the fuse cartridge 54 in the proper location, e.g. accomplished in a specific illustrative embodiment by a flexible attachment element 58 (FIG. 2) or the like, which is affixed to the lower terminal 56 of the fuse cartridge 54 and then removed after installation. The cap 46 is then replaced and the fuse tube assembly 15 is ready for installation into service. If the current-limiting section 16 also operated, as verified by a continuity check, a new limiter assembly 17 is assembled to the refused fuse tube assembly 15. On the other hand, if the limiter assembly 17 did not operate, the original limiter assembly 17 is reassembled onto the refused fuse tube assembly 15.

Figure 8:
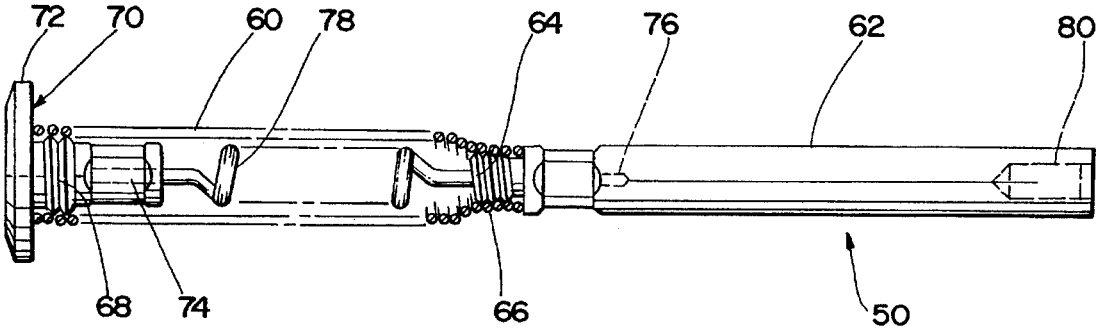
FIG. 8 is an elevational view of a spring/cable assembly of the composite drop-out fuse of FIGS. 1–3 with parts cut away for clarity.

With reference now to the more detailed aspects of the spring/cable assembly 50 and with additional reference to FIG. 8, a first end of an extension spring 60 is affixed to an interconnection rod 62, for example via a threaded portion 64 of the rod 62 and a portion 66 of the spring 60 with several turns of reduced diameter. The other end of the extension spring 60 is affixed to a threaded portion 68 of an upper spring ferrule 70. The upper spring ferrule 70 includes a widened disc-shaped cap portion 72 which is fabricated to be wider than the opening 39 of the upper ferrule 38 of the fuse tube assembly 15, for the purpose of maintaining the installed spring/cable assembly 50 in the appropriate position. Each of the upper spring female 70 and the interconnection rod 62 include respective central bores 74,76. A conductive cable 78 is disposed inside the spring 60 (assembled prior to the affixing of the spring 60) that is of sufficient length to accommodate the length of the extension spring 60 in its maximum extended operating position. The cable 78 is wound in an opposite sense to that of the spring 60. The ends of the cable 78 are affixed to the spring ferrule 70 and the rod 62 via the insertion into the bores 74,76 followed by appropriate process steps, for example, by swaging operations. Accordingly, when the spring/cable assembly is in operative position within the upper ferrule 38, a suitable conductive path is established from the upper ferrule 38 to the lower end of the extension rod 62. The extension rod 62 at its lower end includes a central threaded bore 80 for use in assembly to the fuse cartridge 52. In a preferred embodiment, the rod 62 is fabricated from conductive material. However, in alternative embodiments, the suitable conductive path is established to the cable 78 via any of various conductive path arrangements through the rod 62.

Figure 9:
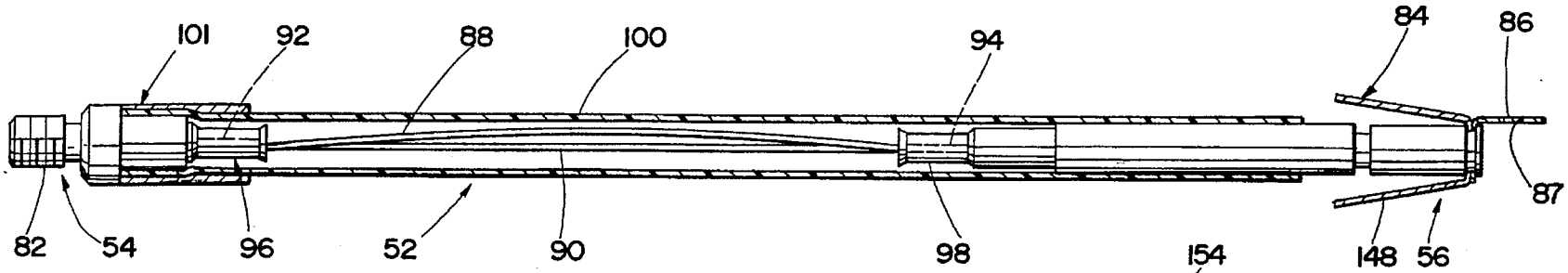
FIG. 9 is an elevational view of a fuse cartridge of the composite drop-out fuse of FIGS. 1—3 with parts cut away for clarity.

Referring now to FIG. 9, the upper terminal 54 of the fuse cartridge 52 includes a threaded top portion 82 to thread into the threaded bore 80 of the rod 60 of the spring/cable assembly 50. The lower terminal 56 includes a contact 84 which is utilized to retain the fuse cartridge 52 in the fuse tube assembly 15 and provide electrical connection through the fuse tube assembly 15 to the limiter assembly 17 as will be explained in more detail hereinafter. A loading clip 86 with retainer aperture 87 (also see FIG. 2) is also carried on the lower terminal 56 to aid in loading/assembling the fuse cartridge 52 into the fuse tube assembly 15, for example, via the attachment of the flexible attachment element 58 or the like as discussed hereinbefore. A fusible element 88 and a strain wire 90 are each disposed between and affixed to the upper and lower terminals 54,56. In a preferred embodiment, the upper and lower terminals 54,56 are provided with respective central bores 92,94 into which the ends of the fusible element 88 and the strain wire 90 are positioned. The respective end portions 96,98 of the terminals 54,56 are then suitably processed and worked, for example by a swaging operation, to secure the components 88,90 and provide electrical connection and a suitable conductive path.

A sheath 100 of arc-extinguishing material is affixed over the ends of the terminals 54,56 and suitably secured thereto by a process or working operation, for example, by the use of a choke 101 which is swaged on. The sheath 100, in accordance with well-known principles and as utilized in fuse links for cutouts, serves to suitably maintain the integrity of the fuse cartridge 52 under low overcurrent conditions and burst at predetermined pressures in response to predetermined higher overcurrent levels. In this manner, for lower range overcurrents and after the fusible element melts, the current then separates the strain wire 90 and arcing ensues with the sheath 100 remaining intact throughout the current interruption process and provides the desired pressure to extinguish the are. At higher overcurrent levels, the sheath 100 bursts due to the higher pressures developed by the arcing and the arc is extinguished inside the bore of the fuse tube assembly 15.

Figure 10:
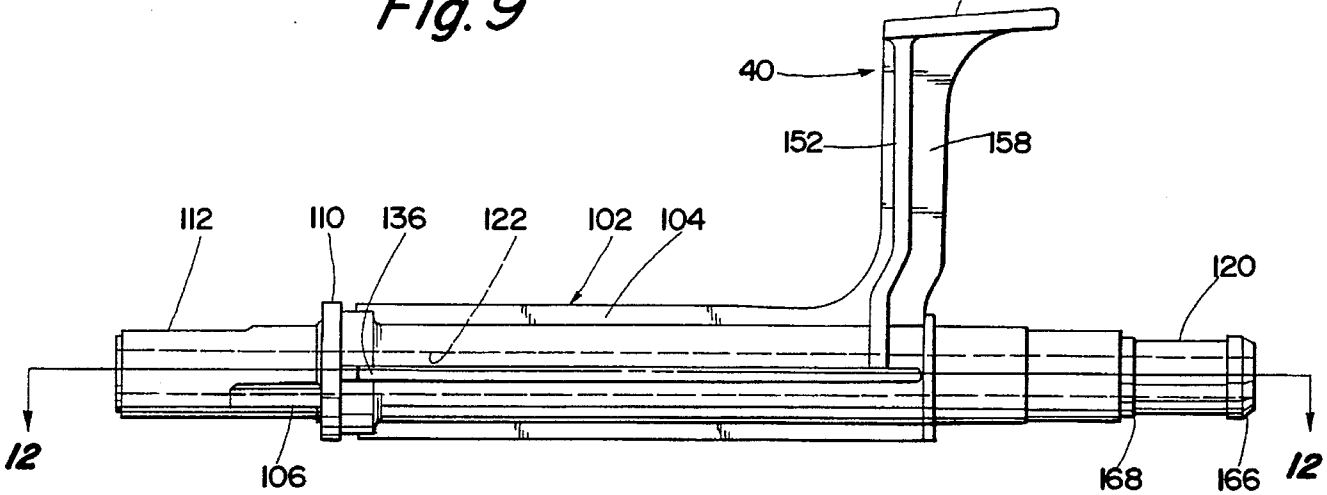
FIGS. 10, 11, and 13 are respective front, right side and bottom elevational views of a fuse tube of the composite/drop-out fuse of FIGS. 1–3.
Figure 11:
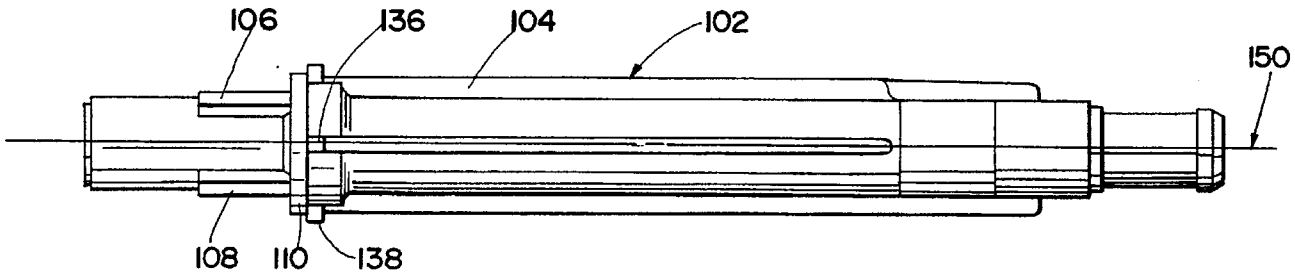
Figure 12:
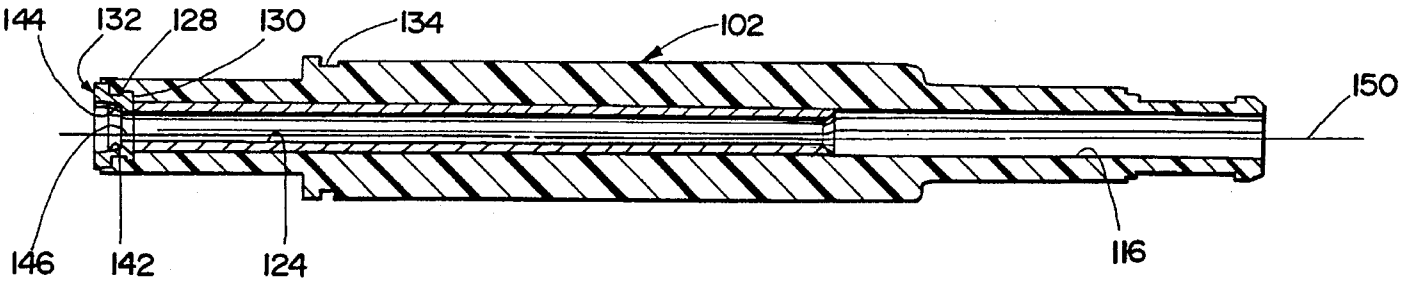
Figure 14:
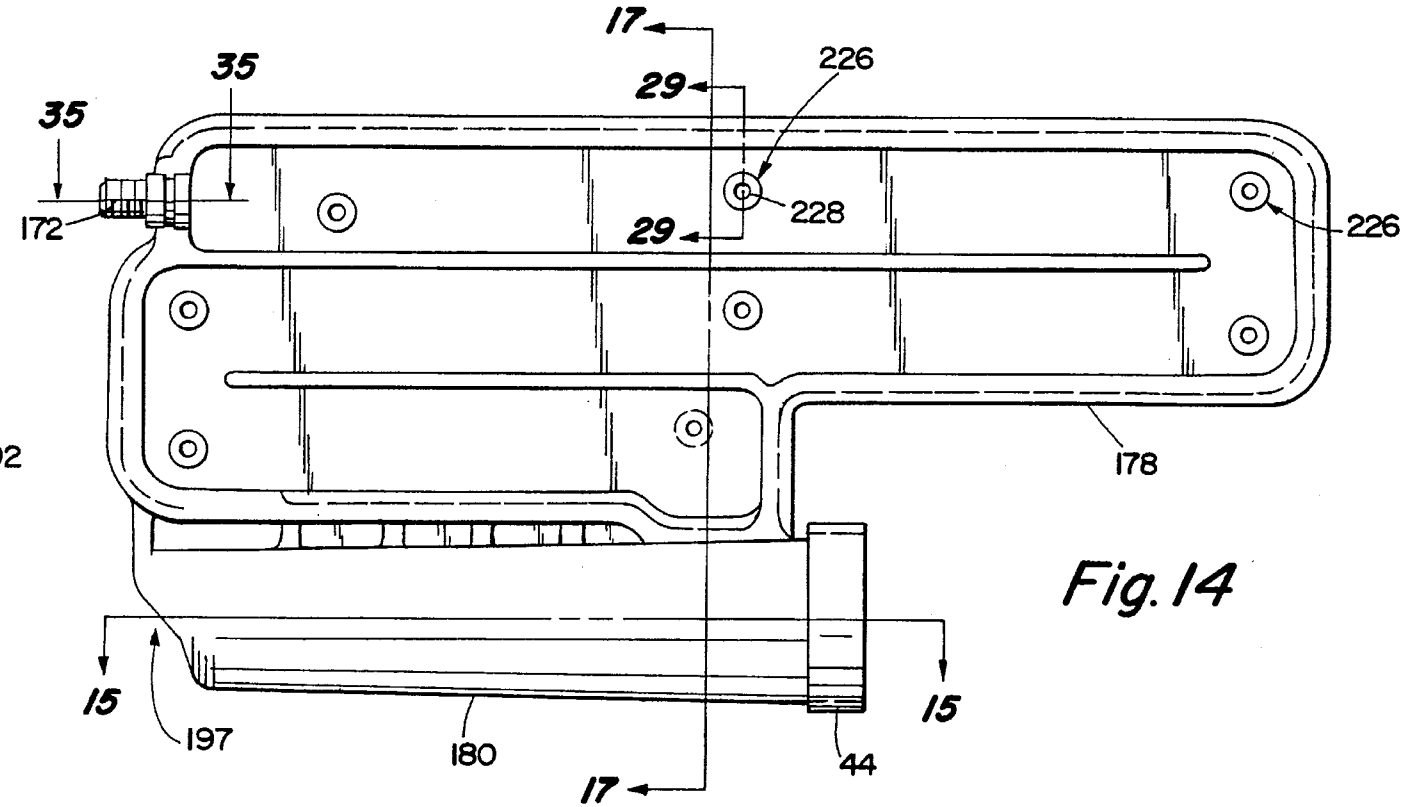
FIGS. 14 and 16 are respective front elevational and bottom plan views of a limiter assembly of the composite drop-out fuse of FIGS. 1–3.
Figure 13:
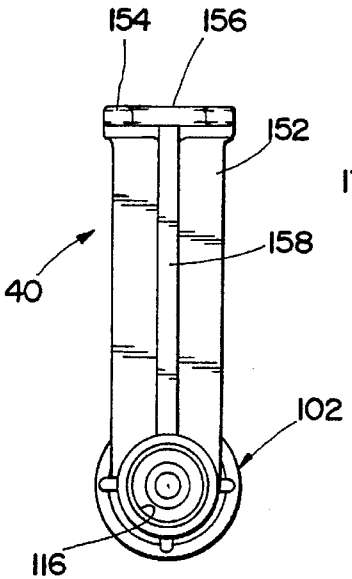
Figure 34:
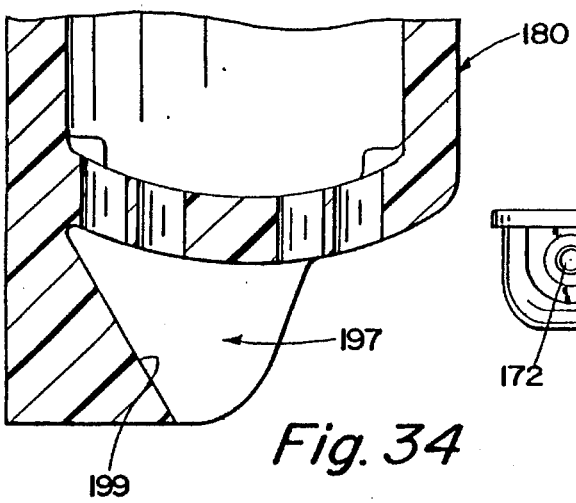
FIG. 34 is a partial sectional view, on an enlarged scale, taken along the line 34—34 of FIG. 16.

With regard to additional aspects of the fuse tube assembly 15 and referring additionally to FIGS. 10–13, the fuse tube assembly 15 includes a fuse tube 102. In the preferred embodiment, the fuse tube 102 is fabricated in a molding process from a suitable thermoplastic (e.g. polycarbonate, polyester, polyamide, polyacetate, etc.) with all the features as shown in FIGS. 10, 11 and 13, although in alternative embodiments it should be realized that the fuse tube 102 is fabricated by machining the various features or by affixing/securing of parts thereon. For example, the guide/support arm 40, is molded as part of the fuse tube 102. Additionally, the fuse tube 102 also includes four circumferentially spaced stiffener/strengthening ribs 104 and various features for cooperating with the limiter assembly 17 for proper orientation, assembly, and operation of the assembled fuse tube assembly 15 and the limiter assembly 17. In the specific illustrated embodiment, the lower end or neck portion 105 of the fuse tube 102 includes locating/orientation protuberances 106 and 108, a widened sealing flange portion 110, and a recessed area 112 for receiving a contact arm 114 (FIGS. 2 and 3) that provides electrical connection to the limiter assembly 17. The fuse tube 102 includes a cylindrical central bore 116 and additional features formed within the bore 116.

Considering the assembly of the upper ferrule 38 onto the fuse tube 102 of the fuse tube assembly 15, the upper ferrule 38 is retained on the fuse tube 102 by a resilient split ring 162 (FIG. 3). Additionally, the upper ferrule 38 is biased away from the fuse tube 102 (upwardly in FIG. 3) by the provision of a compression spring 164 (FIG. 3) which is arranged between the fuse tube 102 and the inner passage of the upper ferrule 38. Specifically, the upper ferrule 38 with the spring 164 and the split ring 162 are assembled onto the fuse tube 102. The split ring 162 first expands over the widened end portion 166 of the fuse tube 102 and continues to move along the fuse tube 102 until it reaches the widened portion 168 of the fuse tube 102 adjacent the narrowed section 120. At that point, the split ring 162 expands into the groove 169 of the upper ferrule 38, where it then remains. Thereafter, while the upper ferrule 38 can move with respect to the fuse tube 102 and under the bias of the spring 164, the upper ferrule 38 is retained on the fuse tube 102 since the split ring 164 prevents the upper ferrule 38 from moving past the point where the split ring 162 interferes with the widened portion 166 at the end of the fuse tube 102.

The fuse tube assembly 15 further includes an arc extinguishing tube 124 that is fabricated from suitable arc extinguishing material. The are extinguishing tube 124 is preferably molded into the fuse tube 102 during fabrication. The bore 116 of the fuse tube 102 also includes a widened lower section with wall and shoulder features at 128 and 130 for receiving and retaining a contact 132 in the shape of a ring (annulus). The assembly of the contact 132 (e.g. via interference fit) retains the arc extinguishing tube 124 within the fuse tube 102. The contact arm 114 is affixed to the contact 132 (as shown in FIGS. 2 and 3). As seen in FIG. 3, when the fuse cartridge 52 is assembled into the fuse tube assembly 15, the contact 84 of the lower terminal 56 of the fuse cartridge 52 seats upon and provides an electrical connection to the contact 132, the contact arm 114 connected to the contact 132 providing electrical circuit connection to a terminal connector 140 (FIG. 3) of the limiter assembly 17 when the fuse tube assembly 15 is assembled to the limiter assembly 17 as will be explained in more detail hereinafter. The contact 132 is fabricated with an inner surface contour at 142 and a central shoulder 144 with central aperture 146 to cooperate with the contact 84. Specifically, the contact 84 is fabricated with legs 148 (FIGS. 2,3 and 9) that are resilient and flexible and extend outwardly from the central portion of the contact 84.

Figure 2:
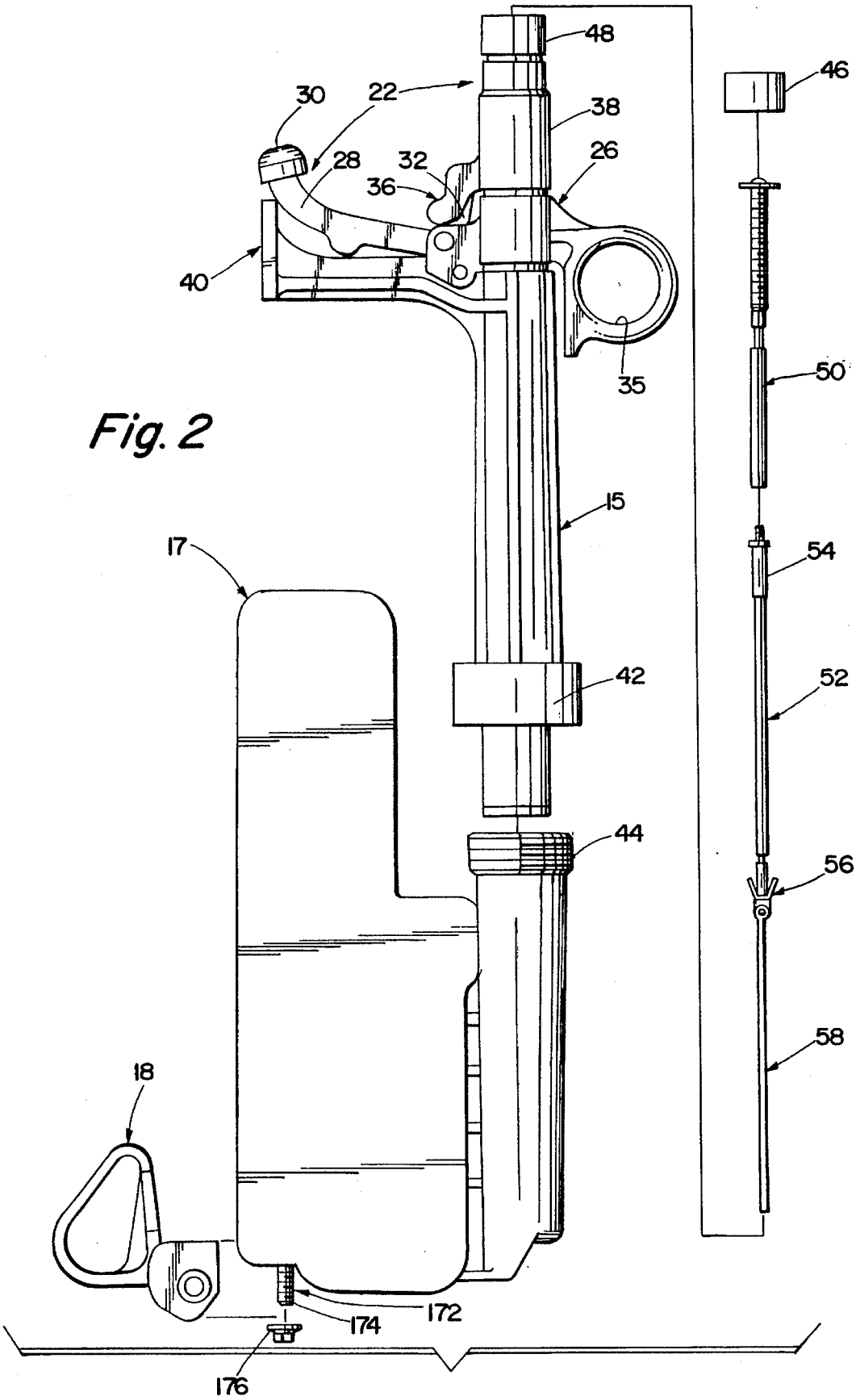
FIG. 2 is an exploded view of the components and assemblies of the composite drop-out fuse/of FIG. 1 and illustrating assembly/disassembly for refusing.
Figure 3:
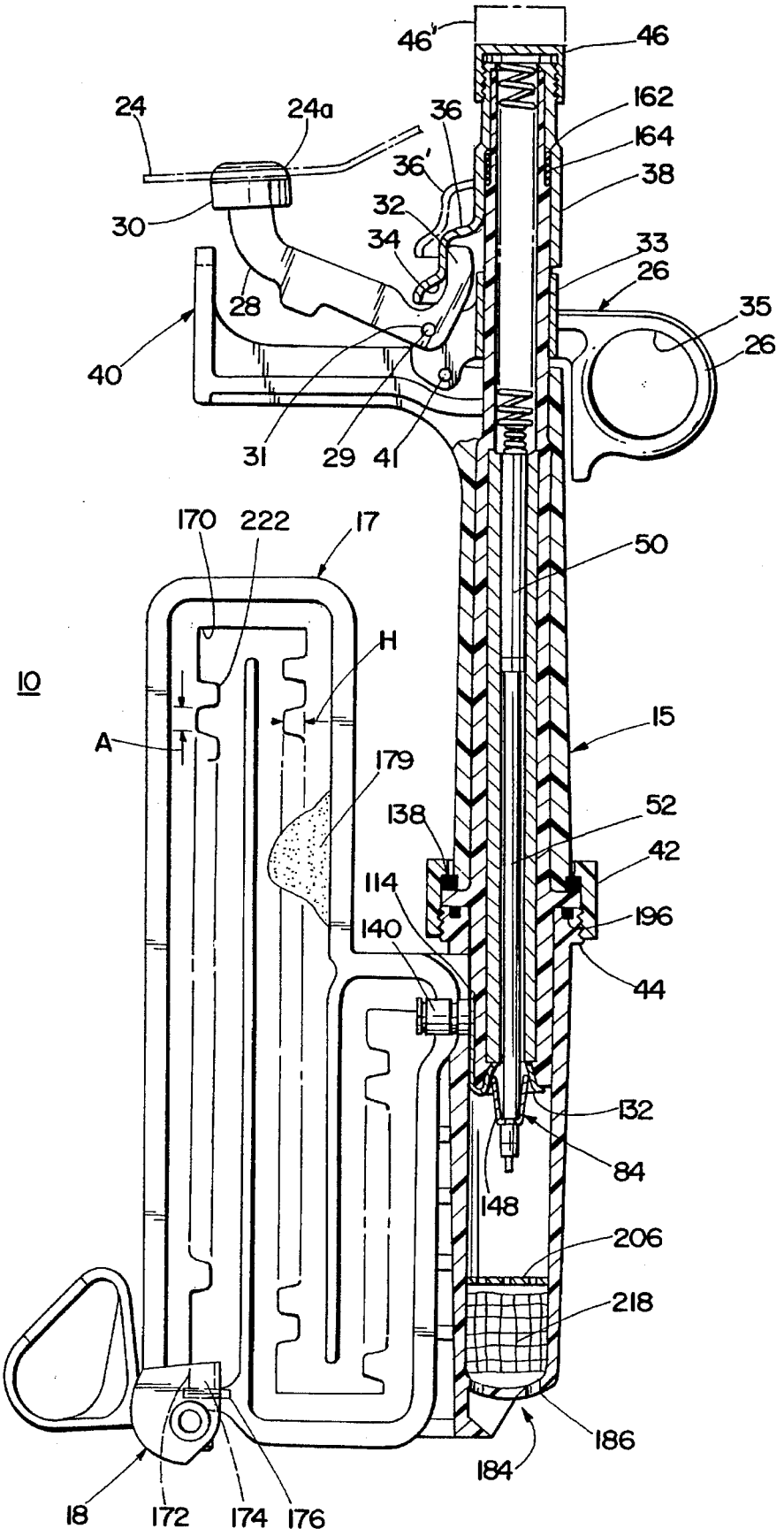
FIG. 3 is a front elevational view of the composite drop-out fuse of FIGS. 1 and 2, partly in section and with parts removed and cut away for clarity.

When the spring cable 50 with attached fuse cartridge 52 are positioned through the top opening of the upper ferrule 38 and pulled (via the flexible attachment element 58 as illustrated in FIG. 2) by stretching of the spring 60 downward through the contact 132, upon lessening of the tension in the string/weight attachment 58, the legs 148 move over the contour surface 142 and seat on the shoulder 144 as shown in FIG. 3, thus retaining the fuse cartridge 52 and attached spring/cable assembly 50 in operative position within the fuse tube assembly 15, the cap 72 of the spring/cable assembly 50 being seated atop the exterior of the upper ferrule 38. The cap 46 is threaded onto the upper ferrule 38 to close the top of the fuse tube 102. The fuse tube 102 is also fabricated to provide a circumferentially defined recess 134 via the cooperation of the flange portion 110 and notched or reduced height portions 136 of the stiffener ribs 104. The threaded collar 42 of the fuse tube assembly 15 is positioned onto the fuse tube 102 over the lower end and the flange 110 and over the stiffener ribs 104. A resilient split ring 138 (FIG. 3) is snapped into place in the recess 134 so as to retain the threaded collar 42 on the fuse tube assembly 15.

The guide/support arm 40 of the fuse tube assembly 15 extends at approximately a right angle to the longitudinal axis 150 of the fuse tube 102. The length of the extending portion 152 is defined along with the movable contact arm 28 so that the guide/support arm 40 rests against the central portion of the attachment hooks 27 of the cutout mounting 12 when the contact 30 of the contact arm 28 is in an aligned position with the indentation 24*a* of the spring contact 24 of the cutout mounting 12. At the end of the extending portion 152, the guide/support arm 40 includes a generally transverse upstanding planar portion 154 that forms a slight angle outwardly from the longitudinal axis 150 of the fuse tube 102. The upstanding planar portion 154 includes a wide notched section 156 to provide clearance for the contact 30 when the movable contact arm 28 pivots to the open position when released by upward movement of the upper ferrule 38. When the movable contact arm 28 is released, it pivots so as to rest against the guide/support arm 40 as shown in FIG. 2. Specifically, the extending portion 152 of the guide/support arm 40 includes an upstanding rib 158 and the movable contact arm 28 includes a lower projection 160 (FIGS. 2,3 and 4, best seen in FIG. 4) which is dimensioned so as to rest against the guide/support arm 40 when the outer part of the contact arm 28 comes to rest in the notch portion 156.

The limiter assembly 17 is basically of the same general type as shown in the aforementioned copending application Serial No. (attorney docket reference Case SC-5246) to which reference may be made for a more complete description of the features and aspects of that basic type of current-limiting device and housing configuration. However, in accordance with important aspects of the present invention, the limiter assembly 17 includes provisions for electrically connecting the limiter assembly 17 and for providing predetermined exhaust control and venting functions for the low-current section 14 when assembled with the fuse tube assembly 15 in the predetermined configuration as shown in FIGS. 1 and 3. To this end and as discussed hereinabove, the threaded collar 42 of the fuse tube assembly 15 is threaded onto the threaded portion 44 of the limiter assembly 17 with electrical connection being accomplished via the contact arm 114 against the terminal connector 140 of the limiter assembly 17. As shown in FIG. 3, the limiter assembly 17 includes a fusible element 170 fabricated as a conductive ribbon that is disposed around the limiter assembly 17 in a circuitous path having two back to back U-shaped portions in the illustrated embodiment. The fusible element 170 at one end is connected to the terminal connector 140. The other end of the fusible element 170 is connected to a second terminal connector 172 which extends to the exterior of the limiter assembly 17 and includes a threaded portion 174. In the preferred embodiment, the trunnion 18 is affixed to the limiter assembly 17 via a threaded fastener 176.

Figure 35:
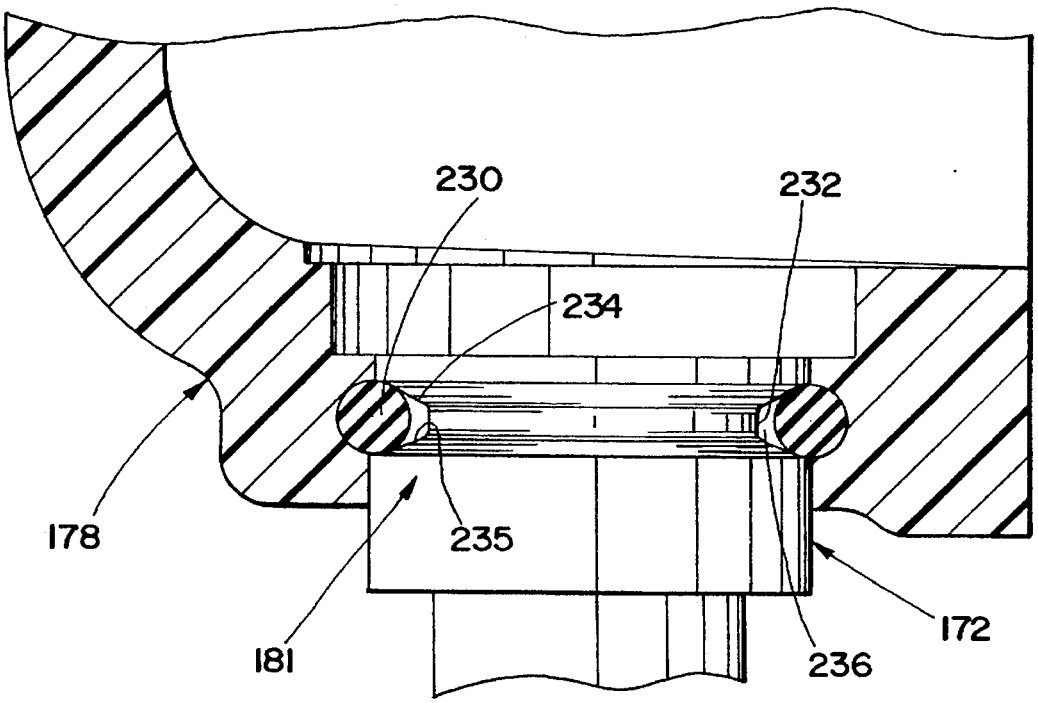
FIG. 35 is a partial sectional view, on an enlarged scale, taken along the line 35—35 of FIG. 14.

Referring now additionally to FIGS. 14–24 and 33–35, the limiter assembly 17 includes a housing portion 178 (FIGS. 14–17) which is preferably molded as a single integral part and houses the fusible element 170 (FIG. 3) in sand or other fulgarite-forming filler material 179 (FIG. 3). In accordance with the present invention, preferably the terminals 140,172 are incorporated into the housing portion 178 during the molding thereof. In order to isolate the interior of the limiter assembly 17 from the environment and to contain internally generated pressure and gas during fuse operation, sealing provisions referred to generally at 181 are provided at the interface of the terminal connectors 140,172 and the material of the housing portion 178 so as to form a seal at the time of fabrication during the molding process. Specifically, before the molding of the housing portion 178, an O-ring 230 (FIGS. 17 and 35) is positioned over a groove 232 in each of the terminal connectors 140,172. As shown in FIG. 35, the groove 232 is circumferentially formed around each of the terminal connectors 140,172 with inclined sidewalls 234,235 so as to define a narrowed bottom of the groove 232 relative to top of the groove 232 where it meets the outer surface of the terminal connectors 140,172. The dimensions of the O-ring 230 (preferably of elastomeric material) and the groove 232 are defined such that the O-ring 230 must be stretched (i.e. be in tension) when positioned in and over the groove 232. Thus, as shown in FIG. 35, a sealed air space 236 is provided in the groove 232 between the O-ring and the terminal connectors 140, 172. Accordingly, during molding of the housing portion 178, the molding material is injected at high pressure and forces the O-ring 230 in the groove 232. This avoids the flow of any of the injected molding material in the air space 236, i.e. between the O-ring 230 and the terminal connectors 140,172, since such flow could result in a tendency to leak.

Figure 29:
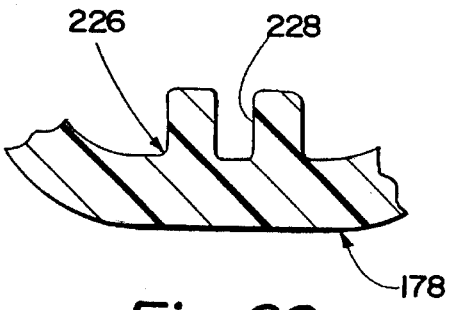
FIG. 29 is a partial sectional view taken along the line 29—29 of FIG. 14.
Figure 30:
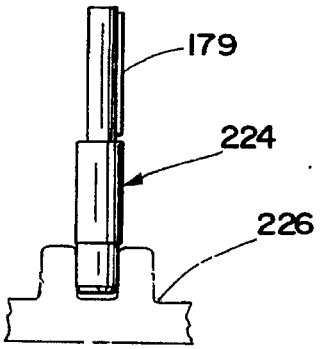
FIG. 30 is an elevational view of a fusible element support for use with the limiter assembly of FIGS. 14–17.

With additional reference to FIGS. 29 and 30, the support of the fusible element 170 within the limiter assembly 17 along the circuitous path is provided by supports 224 that are retained by support structure 226 that are preferably formed during the molding of the housing portion 178. The support structure 226 provides an annular passage 228 into which the support 224 is inserted for retention, e.g. via interference fit and/or adhesive. The fusible element 179 is positioned around the upper portions of the plurality of supports 224 (FIG. 30) at the noted locations of the support structures 226 along the circuitous path as shown in FIG. 3.

Figure 16:
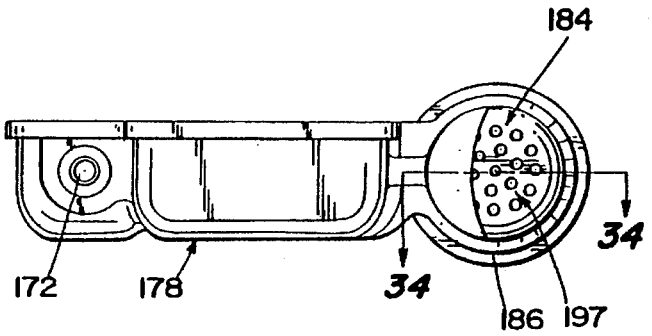
Figure 17:
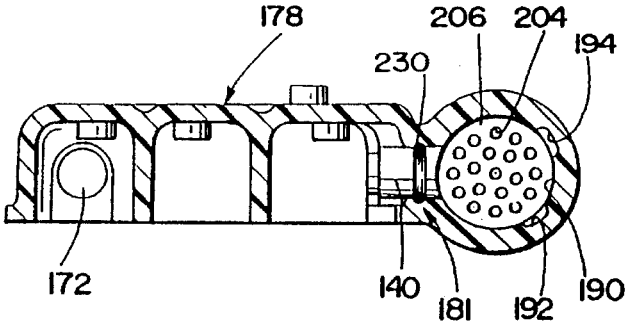
FIG. 17 is a sectional view taken along the line 17—17 of FIG. 14.
Figure 33:
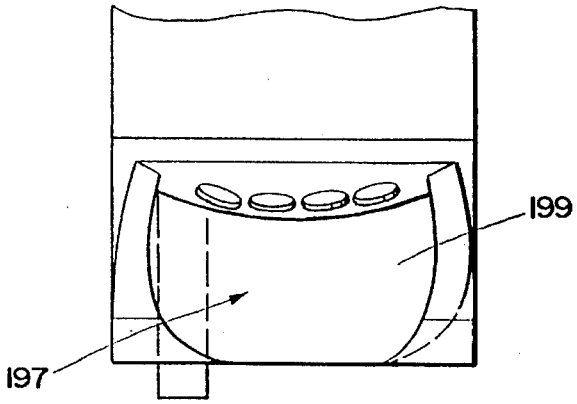
FIG. 33 is a partial right-side elevational view, on an enlarged scale, of the lower portion of the exhaust/venting section of the limiter assembly of FIG. 14.
Figure 18:
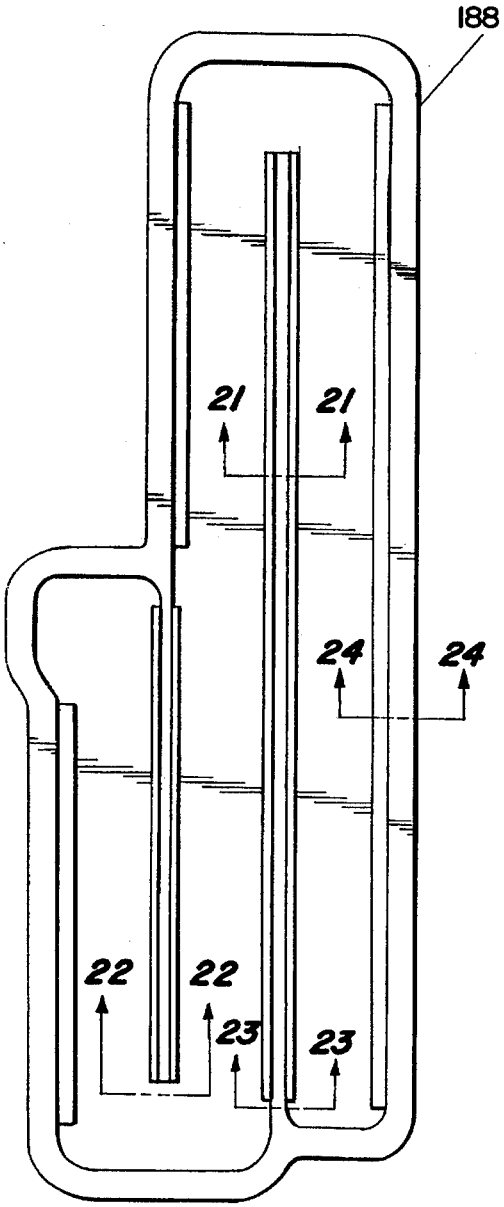
FIGS. 18–20 are respective rear, front, and right-side elevational views of a cover for the limiter assembly of FIGS. 14–17.
Figure 19:
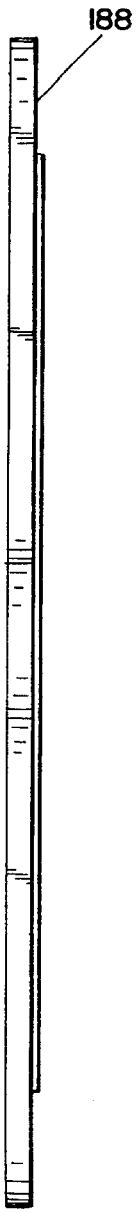
Figure 20:
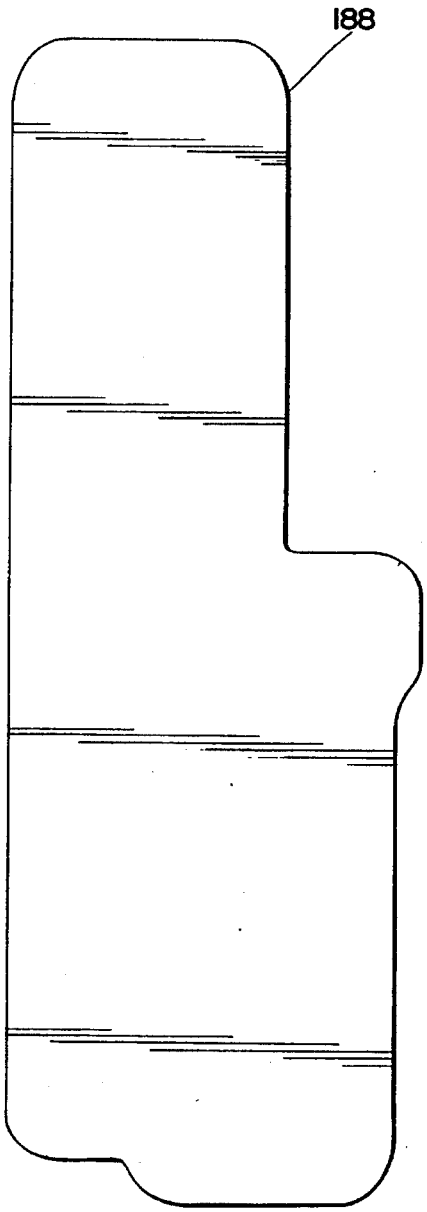
Figure 21:
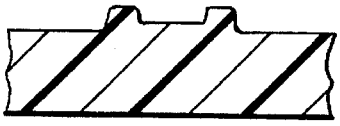
FIGS. 21–24 are sectional views taken respectively along the lines 21—21, 22—22, 23—23, and 24—24 of FIG. 18.
Figure 22:
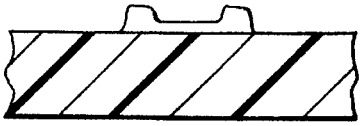
Figure 23:
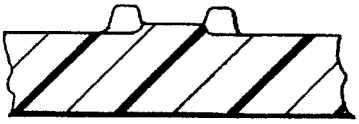
Figure 24:
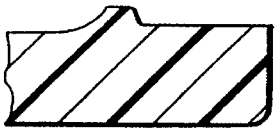

In accordance with important aspects of the present invention, the housing portion 178 is also fabricated to define an exhaust/venting section 180 which as shown in FIG. 3 includes a generally cylindrical open volume 182 and as shown in FIGS. 3, 16 and 17 at the lower end includes a predetermined pattern or array 184 of exhaust ports 186. In a specific embodiment, the exhaust ports 186 are approximately 0.125 of an inch in diameter. The limiter assembly 17 also includes a cover or lid portion 188 (FIGS. 18–20) which is assembled onto the housing portion 178 after the fusible element 170 is affixed and the volume is filled with the material 179.

Figure 15:
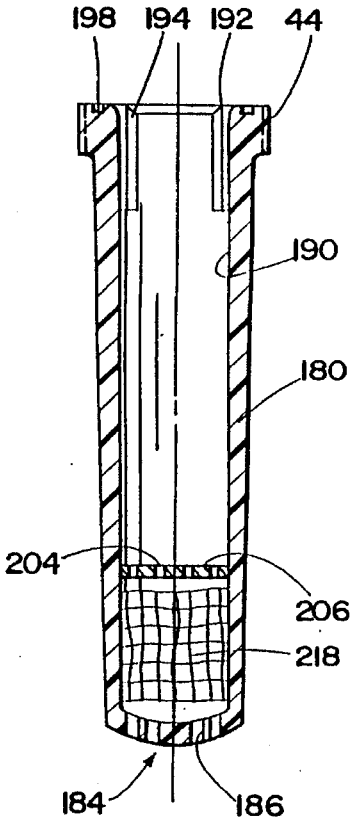
FIG. 15 is a sectional view taken along the line 15—15 of FIG. 14.

With specific reference to FIGS. 15 and 17, the exhaust/venting section 180 is fabricated with a central opening 190 that is dimensioned to receive the lower end or neck portion 105 of the fuse tube assembly 15 to achieve the assembled position shown in FIGS. 1 and 3. The walls of the exhaust/venting section 180 are fabricated with channels or grooves 192,194 for receiving and cooperating with the locating/orienting protuberances 106,108 respectively on the neck portion 105 of the fuse tube assembly 15, thus assuring proper assembly and orientation. The location and size of the protuberances 106,108 and the grooves 192,194 are utilized to distinguish and reject the assembly of fuse tube assemblies 15 and limiter assemblies 17 of different ratings. The fuse tube assembly 15 and the limiter assembly 17 are sealed upon assembly of the threaded collar 42 to the threaded portion 44 via the provision of an annular sealing element 196 (FIG. 3) disposed within an annular groove 198 (FIG. 15) formed in the exhaust/venting section 180 of the limiter assembly 17. The annular sealing element 196 seals against the bottom surface of the flange portion 110 of the fuse tube assembly 15. At the bottom of the exhaust/venting section 180, an exhaust path deflector arrangement 197 (best seen in FIGS. 14,16 and 33–34) extends along three sides of the bottom of the exhaust/venting section 180 and includes an inner guide surface 199 inclined at approximately 30 degrees from the longitudinal axis 216 of the exhaust/venting section 180. The exhaust path deflector arrangement 197 orients exhaust gases away from the vicinity of the hinge mounting arrangement 20 and the connected cable (not shown), thus avoiding the possibility of flashover that might be caused by ionized exhaust gases reaching these areas. Preferably, the exhaust path deflector 197 is formed during the molding of the housing portion 178 of the limiter assembly 17. Additionally, a heat-absorbing medium 218 (FIG. 15), e.g. in the form of a copper screen or the like, is provided in the bottom of the exhaust/venting section 180 to cool and aleionize the exhaust gases. Further, a deflector plate 206 with apertures 204 (FIGS. 15 and 17) is provided in the exhaust/venting section 180 above the heat-absorbing medium 218. The limiter assembly 17 is fabricated from a suitable glass filled thermoplastic, e.g. polyphthalamide, polyethylene terephthalates, polyamides, polyetherimides, etc.

Figure 32:
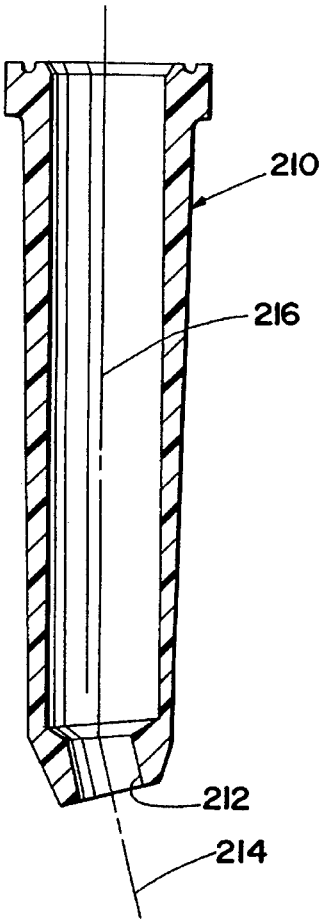
FIG. 32 is a sectional view similar to FIGS. 14 and 15 illustrating an alternate exhaust/venting section of the limiter assembly.

With additional reference now to FIG. 32, another specific, alternative embodiment of an exhaust/venting section 210 for the limiter assembly 17 is illustrated having an exhaust port 212 that forms an angle as denoted by axis 214 with respect to the longitudinal axis 216 for the purposes of directing any exhaust gases away from the limiter 17 to avoid the possibility of flashover during high-current interruptions.

Figure 31:
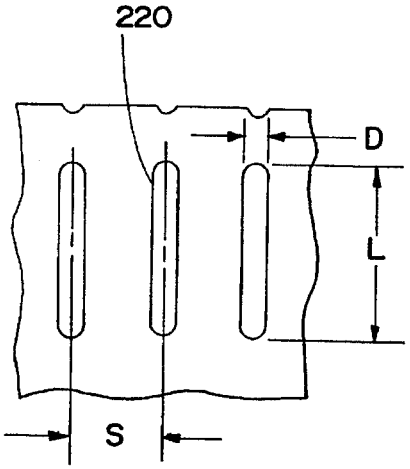
FIG. 31 is a plan view of a portion of the fusible element of the composite drop-out fuse of FIGS. 1–3.

The basic parameters for a suitable fusible element 170 for use with the fuse 10 are discussed in the aforementioned copending application Serial No. 08/225,161. Specifically, the achievement of a small volume low-profile housing for the limiter assembly 17 is made possible by the fusible element 170 being fabricated with closely spaced tooth-like undulations or departures, referred to at 222 in FIG. 3, from the circuitous path of the fusible element 170 along with closely spaced areas of reduced cross-section of the fusible element 170, for example as defined by holes, notches etc. Referring now additionally to FIG. 31 wherein the areas of reduced cross-section are implemented by holes 220 and considering a specific illustrative example, the following parameters (specified in inches) have been found suitable for the fusible element 170 to achieve suitable performance and operation of the fuse 10, i.e. the limiter assembly 17 in combination with the fuse cartridge 52 of the fuse tube assembly 15, with the fuse cartridge being equipped with a fusible element 88 corresponding to a 20K type TCC in the industry (corresponding to a 20 ampere rating at K speed TCC performance):

(in inches)

W=0.311 (Width of fusible element 170);

T=0.0045 (Thickness of fusible element 170;

L=0.185 (Expanse of hole 220 across W in addition to 0.013" total of side notches);

D=0.032 (Expanse of hole 220 along fusible element 170);

S=0.117 (Spacing of holes 220 along fusible element 170);

A,H—See FIG. 3:

A=0.211 (Length along path between bends 222);

H=(Amplitude or departure of bend 222 from path)—as determined to achieve desired length of path and consistent with path width of housing and fulgarite growth. In the illustrative example, H is in the range of 0.15–0.25.

As an illustration, the fuse 10 as described herein has been found to interrupt currents in the range of 10–12,000 amperes on electrical power distribution systems operating at 25,000 volts.

Referring now to FIGS. 25–28, the trunnion 18 is fabricated with extending portions 200,202 that interfit with the lower mounting hinge 20 of the cutout mounting 12.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A fuse for use in an electrical mounting having spaced apart upper and lower terminals and mounting arrangements, the fuse comprising:

a housing comprising a first housing portion and a second housing portion, at least a substantial part of said second housing portion being arranged alongside said first housing portion;

fusible element means for defining predetermined current limiting and current interruption characteristics, said fusible element means comprising a first fusible element disposed within said first housing portion and a second fusible element disposed within said second housing portion, said first and second fusible elements being connected in an electrical series-circuit relation, said first fusible element operating in response to overcurrents above a first predetermined level in accordance with predetermined time-current characteristics and said second fusible element providing predetermined current-limiting characteristics in a current-limiting mode to limit overcurrents only when the overcurrence level exceeds a second predetermined level higher than said first predetermined level; and means carried by said housing for supporting said housing within and for providing electrical connection of said series-circuit relation of said connected first and second fusible elements to the spaced apart upper and lower terminals and mounting arrangements of the electrical mounting.

2. The fuse of claim 1 wherein said first housing portion has a generally tubular section which defines a longitudinal axis, said second housing portion being arranged so as to extend away and be offset from said longitudinal axis.

3. The fuse of claim 2 wherein said generally tubular section extends along said longitudinal axis a distance that is a substantial portion of the spacing between the spaced apart upper and lower terminals and mounting arrangements of the electrical mounting.

4. The fuse of claim 1 wherein said second housing portion is generally flat and planar shaped.

5. The fuse of claim 1 wherein said first housing portion includes first and second separable sections including cooperating means for assembling said first and second separable sections to provide said first housing portion.

6. The fuse of claim 5 wherein said first separable section carries said first fusible element means.

7. The fuse of claim 6 wherein said second separable section is integral with said second housing portion.

8. The fuse of claim 7 wherein said second separable section comprises exhaust control means defining predetermined venting provisions.

9. The fuse of claim 1 further comprising means carried by said first housing portion and responsive to said first fusible means for releasing said electrical from the fuse mounting in response to operation of said first fusible means.

10. The fuse of claim 1 wherein said fusible dement means further comprises first means for disposing said first fusible element within said first housing portion, said first means comprising a replaceable fuse cartridge including said first fusible element.

11. The fuse of claim 10 wherein said replaceable fuse cartridge comprises means carried at one end thereof for maintaining said one end of said replaceable fuse cartridge with respect to said first housing portion.

12. The fuse of claim 11 wherein said replaceable fuse cartridge further comprises means cooperating with said first means for disposing a second end of said replaceable fuse cartridge in said first housing portion.

13. The fuse of claim 12 wherein said first means further comprises means for applying tension to said replaceable fuse cartridge such that operation of said first fusible element releases said tension.

14. The fuse of claim 1 wherein said supporting and electrical connection providing means further comprises means carried by said second housing portion for pivotally supporting said fuse with respect to the spaced apart upper and lower terminals and mounting arrangements of the electrical mounting.

15. The fuse of claim 1 wherein said first housing portion is generally tubular and includes a bore lined with arc-extinguishing material and provisions for defining predetermined venting characteristics.

16. The fuse of claim 1 further comprising means for replacing said first fusible element after operation thereof independent of said second housing portion and said second fusible element.

17. The fuse of claim 1 wherein said fusible element means further comprises replaceable fuse cartridge means including said first fusible element.

18. The fuse of claim 17 wherein said first housing portion further comprises selectively separable assembly means for replacement of said replaceable fuse cartridge.

19. The fuse of claim 1 wherein said supporting and electrical connection providing means further comprises means responsive to operation of said first fusible element for releasing said fuse from the fuse mounting, said releasing means comprising a pivotally mounted arm carried by said first housing portion that is released to pivot after operation of said first fusible element.

20. A composite fuse that is adapted to be used in an electrical mounting, the mounting being of the type including spaced apart upper and lower contact assemblies, the composite fuse comprising:

a first assembly comprising first fusible means for responding to currents above a first predetermined level for interrupting current flow and first connection means for defining electrical connection terminals connected to said first fusible means;

a second assembly that is a generally flat polyhedron and comprising second fusible means being responsive to overcurrents above a second predetermined level higher than said first predetermined level to provide predetermined current-limiting characteristics, said second assembly further comprising second connection means for defining electrical connection terminals connected to said second fusible means;

said first and second assemblies comprising cooperating means for assembling said first and second subassemblies in a predetermined configuration and for electrically connecting said first and second fusible means in electrical series circuit;

means carded by said first and second assemblies for supporting said first and second assemblies in said predetermined configuration within the electrical mounting; and means for electrically connecting said series connected first and second fusible means of said first and second assemblies in said predetermined configuration between the spaced apart upper and lower contact assemblies of the electrical mounting.

21. A composite drop-out fuse assembly that is for use in an electrical distribution cutout mounting, the mounting being of the type including spaced apart upper and lower contact assemblies, the composite drop-out fuse assembly comprising:

first means being selectively operable for releasing the composite drop-out fuse assembly from the electrical distribution cutout mounting so that the composite drop-out fuse assembly moves to a drop out position;

fuse tube assembly means for responding to currents above a first predetermined level for interrupting current flow and for operating said first means; and current limiting assembly means being responsive to currents above a second predetermined level greater than said first predetermined current level for limiting the current in accordance with predetermined current limiting characteristics, said fuse tube assembly means and said current limiting assembly means comprising cooperating means for assembling said current limiting assembly means and said fuse tube assembly means into a predetermined assembled configuration so as to be self-supporting in the electrical distribution cutout mounting, said current limiting assembly means further comprising exhaust control means for providing in said predetermined assembled configuration predetermined venting characteristics for said fuse tube assembly means for controlling the exhaust of said fuse tube assembly into the environment external to said composite drop-out fuse assembly, said fuse tube assembly means and said current limiting assembly means further comprising means for electrically connecting said fuse tube assembly means and said current limiting assembly means in electrical series relationship when assembled into said predetermined assembled configuration, said fuse tube assembly means further comprising second means for providing electrical connection to a first of the spaced apart upper and lower contact assemblies of the electrical distribution cutout mounting, said current limiting assembly means further comprising third means for providing electrical connection to a second of the spaced apart upper and lower contact assemblies of the electrical distribution cutout mounting, said second and third means being arranged in said predetermined assembled configuration such that an electrical series circuit is established through said fuse tube assembly means and said current limiting assembly means between the spaced apart upper and lower contact assemblies of the electrical distribution cutout mounting.

22. The composite drop-out fuse assembly of claim 21 wherein said fuse tube assembly means includes tubular exhaust means for defining an exhaust output, said cooperating means comprising first assembly means carried by said fuse tube assembly and second assembly means carried by said current limiting means, said first assembly means being located adjacent said exhaust output.

23. The composite drop-out fuse assembly of claim 22 wherein said exhaust control means includes a tubular portion, said first and second assembly means comprising interfitting threaded portions that are capable of selective assembly and disassembly.

24. The composite drop-out fuse assembly of claim 23 wherein said interfitting threaded portions comprise a collar having internal threads and an externally threaded portion.

25. The composite drop-out fuse assembly of claim 24 wherein said collar is disposed about said tubular exhaust means and said externally threaded portion is carried by said tubular portion of said exhaust control means.

26. The composite drop-out fuse assembly of claim 25 further comprising means operative upon assembly of said first and second assembly means for providing a seal between said tubular exhaust means and said exhaust control means.

27. A composite drop-out fuse assembly that is designed to be used in an electrical distribution cutout mounting, the electrical distribution cutout mounting being of the type including spaced apart upper and lower contact assemblies that are relatively movable upon insertion of the composite drop-out fuse assembly into the electrical distribution cutout mounting to provide a retention force for the composite drop-out fuse assembly, the composite fuse assembly comprising:

a first assembly comprising first fusible means for responding to currents above a first predetermined level for interrupting current flow and first connection means for defining electrical connection terminals connected to said first fusible means; and a second assembly comprising second fusible means being responsive to limit overcurrents from exceeding a second predetermined peak level that is higher than the peak levels of said first predetermined level and second connection means for defining electrical connection terminals connected to said second fusible means;

said first and second assemblies further comprising means for assembling said first and second assemblies in a predetermined configuration so as to be selectively retained within the electrical distribution cutout mounting without the provision of a tensioned fuse link cable exiting from an open fuse tube as found in a standard cutout and for electrically connecting said first and second fusible means in electrical series circuit, said first and second connection means being arranged for supporting said first and second assemblies in said predetermined configuration within the electrical distribution cutout mounting and electrically connecting said series connected first and second fusible means between the spaced apart upper and lower contact assemblies of the electrical distribution cutout mounting.

28. A composite drop-out fuse assembly for use in an electrical distribution cutout mounting, the electrical distribution cutout mounting being of the type including spaced apart upper and lower contact assemblies that are relatively movable upon insertion of the composite drop-out fuse assembly into the electrical distribution cutout mounting to provide a retention force for the composite drop-out fuse assembly, the composite fuse assembly comprising:

a first assembly comprising first fusible means for responding to currents above a first predetermined level for interrupting current flow and first connection means for defining electrical connection terminals connected to said first fusible means; and a second assembly comprising second fusible means being responsive to limit overcurrents from exceeding a second predetermined peak level higher than the peak levels of said first predetermined level and second connection means for defining electrical connection terminals connected to said second fusible means;

said first and second assemblies further comprising means for assembling said first and second assemblies in a predetermined configuration and for electrically connecting said first and second fusible means in electrical series circuit, said first and second connection means being arranged for supporting said first and second assemblies in said predetermined configuration within the electrical distribution cutout mounting and electrically connecting said series connected first and second fusible means between the spaced apart upper and lower contact assemblies of the electrical distribution cutout mounting, said first and second assemblies in said predetermined configuration further comprising means for providing predetermined venting of said first fusible means that does not include an open-ended fuse tube as defined by a standard cutout fuse tube and does not include provisions for the securing of a fuse link cable as defined by a standard cutout.

29. A composite drop-out fuse assembly for use in an electrical mounting, the mounting being of the type including spaced apart upper and lower contact assemblies, the composite fuse assembly comprising:

a first assembly comprising first fusible means for responding to currents above a first predetermined level for interrupting current flow and first connection means for defining electrical connection terminals connected to said first fusible means; and a second assembly comprising second fusible means being responsive to overcurrents above a second predetermined level higher than said first predetermined level for providing predetermined current-limiting characteristics, said second assembly further comprising second connection means for defining electrical connection terminals connected to said second fusible means;

said first and second assemblies further comprising means for assembling said first and second assemblies in a predetermined configuration and for electrically connecting said first and second fusible means in electrical series circuit, said first and second connection means being arranged for supporting said first and second assemblies in said predetermined configuration within the electrical mounting and electrically connecting said series connected first and second fusible means between the spaced apart upper and lower contact assemblies of the electrical mounting, said first assembly further comprising an open bore of arc-extinguishing material in which said first fusible means is disposed, said first and second assemblies further comprising means for providing venting of said open bore and said first fusible means into the environment external to said composite drop-out fuse assembly, said venting means comprising a predetermined array of openings, each of said openings being substantially smaller than said open bore, said first fusible means comprising a fuse cartridge including means for retaining a first end of said fuse cartridge within said first assembly, said first assembly further comprising third means including provisions for cooperating with said fuse cartridge to retain said fuse cartridge within said first assembly and through said open bore and for providing predetermined tension to said fuse cartridge.

30. A composite fuse assembly comprising:

a first section including a molded housing having a general flat planar shape and first fusible means disposed in said molded housing for limiting current in accordance with predetermined characteristics; and a second section including a generally tubular shaped molded housing defining a longitudinal axis and second fusible means disposed in said tubular shaped housing for interrupting current in accordance with predetermined characteristics, each of said first and second sections including means for cooperating to interconnect said first section and said second section in a predetermined mechanical configuration wherein said first and second sections are disposed in a generally side by side relationship with said first section being arranged generally parallel to said longitudinal axis of said second section, said first and second sections further comprising first terminal connection and second terminal connection means, each of said first terminal connection means extending externally with respect to said respective housing, each of said second terminal means being configured to provide electrical interconnection of said first and second sections such that an electrical series connection is provided between said first terminal connection means.

31. A fuse for use in an electrical mounting having spaced apart upper and lower terminals and mounting arrangements, the fuse comprising:

a housing, said housing comprising a first section that is generally elongated so as to define a longitudinal axis, said first section having an overall dimension along said longitudinal axis that is at least a substantial portion of the distance between the upper and lower terminals of the electrical mounting for which it is specified, said housing further comprising a second section that extends transversely to said longitudinal axis of said first section and along at least part of said first section in a direction parallel to said longitudinal axis;

fusible means disposed through said first and second sections for responding to overcurrents above a first predetermined level so as to interrupt current flow and for responding to limit overcurrents below a second predetermined level greater than said first predetermined level; and means carried by said housing for supporting said housing in the fuse mounting and for providing electrical connection of said fusible means to the upper and lower terminals of the fuse mounting.

32. A composite drop-out fuse assembly that is adapted to be used in an electrical mounting, the mounting being of the type including spaced apart upper and lower contact assemblies, the composite drop-out fuse assembly comprising:

first means for interrupting overcurrents which exceed a first predetermined level and for limiting overcurrents below a second predetermined level; and second means for housing said first means and physically supporting and electrically connecting said first means between the spaced apart upper and lower contact assemblies, said first means comprising low-current circuit interrupter means including fusible means, said second means comprising means for supporting said fusible means, said supporting means comprising a fuse tube and means including a predetermined array of exhaust openings for venting said fuse tube into the environment external to said composite drop-out fuse assembly and in a manner that does not define an open-ended fuse tube.

33. A composite drop-out fuse assembly that is adapted to be used in an electrical distribution cutout mounting, the electrical distribution cutout mounting being of the type including spaced apart upper and lower contact assemblies that are relatively movable upon insertion of the composite drop-out fuse assembly into the electrical distribution cutout mounting to provide a retention force for the composite drop-out fuse assembly, the composite drop-out fuse assembly comprising:

first means comprising first housing means and first current-responsive means within said first housing means for responding to overcurrents by limiting the magnitude of overcurrents below a first predetermined level; and second means comprising second housing means and second current-responsive means within said second housing means for responding to overcurrents above a second predetermined level for interrupting current flow, said first and second means comprising cooperating means for assembling said first and second housing means into a predetermined assembled configuration so as to be selectively retained within the electrical distribution cutout mounting, said second housing means comprising third means for defining predetermined venting characteristics for said second current-responsive means, said third means not including an open-ended fuse tube and said second current-responsive means not including a fuse-link cable that passes externally out of said third means.

* * * * *

UNITED STATES PATENT AND TRADEMARK OFFICE

CERTIFICATE OF CORRECTION

PATENT NO. : 5,502,427

DATED : Mar. 26, 1996

INVENTOR(S) : Henry W. Scherer, et al

It is certified that error appears in the above-identified patent and that said Letters Patent is hereby corrected as shown below:

Col. 2, line 63, "carded" should be -- carried --;

Col. 3, line 45, "fuse/of" should be -- fuse of -- (insert space);

Col. 3, line 66, "composite/" should be -- composite -- (remove slant);

Col. 4, line 1, "13" should be -- 12 --;

Col. 7, line 1, "52" should be -- 54 --;

Col. 7, line 29, "female" should be -- ferrule --;

Col. 10, line 5, "(attorney docket reference Case SC-5246)" should be -- 08/225,161 --;

Claim 9, col. 13, line 43, "electrical" should be -- fuse --;

Claim 9, col. 13, line 43, "fuse" should be -- electrical --;

Claim 20, col. 14, lines 40 & 41, "subassemblies" should be -- assembles --;

Claim 20, col. 14, line 44, "carded" should be -- carried --;

Claim 31, col. 18, line 27, "fuse" should be -- electrical --.

Signed and Sealed this

Nineteenth Day of November, 1996

*Attest:*

Bruce Lehman

BRUCE LEHMAN

*Attesting Officer*

*Commissioner of Patents and Trademarks*